United States Patent [19]

Yonezawa

[11] 4,268,615

[45] May 19, 1981

[54] METHOD FOR PRODUCING RELIEF

[75] Inventor: Yoshimichi Yonezawa, Nagano, Japan

[73] Assignee: Matsumoto Yushi-Seiyaku Co., Ltd., Osaka, Japan

[21] Appl. No.: 42,511

[22] Filed: May 25, 1979

[51] Int. Cl.[3] ..... G03C 5/00; G03C 5/24

[52] U.S. Cl. ..... 430/320; 427/56.1; 427/272; 427/282; 427/373; 427/391; 430/325; 430/330; 430/350; 430/354

[58] Field of Search ..... 96/27 R, 35, 38.1, 38.2, 96/48 HD; 427/56.1, 272, 282, 373, 385; 430/322, 325, 330, 346, 348, 353, 354, 350, 320

[56] References Cited

U.S. PATENT DOCUMENTS

| | | | |
|---|---|---|---|
| 2,503,759 | 4/1950 | Murray | 430/354 |
| 2,825,282 | 3/1958 | Gergen et al. | 430/348 X |
| 3,093,478 | 6/1963 | Peterson et al. | 96/35 |
| 3,246,148 | 4/1966 | Troeyer et al. | 430/348 X |
| 3,305,359 | 2/1967 | Delmont | 156/905 X |
| 3,523,791 | 8/1970 | Vrancken et al. | 96/35 X |
| 3,558,881 | 1/1971 | Gold | 430/348 |
| 3,607,273 | 9/1971 | Kinney | 96/35 |
| 3,645,204 | 2/1972 | Gosnell | 430/348 X |
| 3,742,853 | 7/1973 | Landsman | 430/348 X |
| 3,762,944 | 10/1973 | Sloan et al. | 430/348 X |
| 3,808,024 | 4/1974 | Witman | 427/373 X |
| 3,897,247 | 7/1975 | Schadlich et al. | 430/348 X |
| 4,016,814 | 4/1977 | Schank et al. | 427/373 X |
| 4,017,312 | 4/1977 | Erskine et al. | 96/48 HD X |
| 4,019,909 | 4/1977 | Cohen et al. | 96/48 HD X |
| 4,106,938 | 8/1978 | Fletcher et al. | 430/354 X |
| 4,113,487 | 9/1978 | Matsunaga et al. | 96/38.1 |

*Primary Examiner*—Edward C. Kimlin

*Attorney, Agent, or Firm*—Wenderoth, Lind & Ponack

[57] ABSTRACT

A method for producing a relief, which comprises forming a layer of a pattern on the surface of a sheet made of a material having the property of increasing in volume when heated, said pattern being made of a material having a stronger ability to absorb light than the aforesaid material, and then irradiating strong light uniformly on the entire surface of the sheet to selectively heat that portion of the sheet which is adjacent the undersurface of the pattern layer, whereby the pattern layer is raised from the sheet surface corresponding to the increase of the volume of the sheet portion.

4 Claims, 9 Drawing Figures

METHOD FOR PRODUCING RELIEF

Figure 1A:
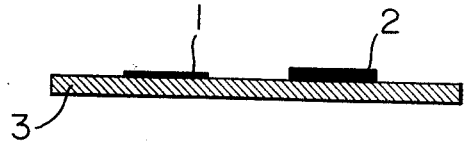
Figure 1B:
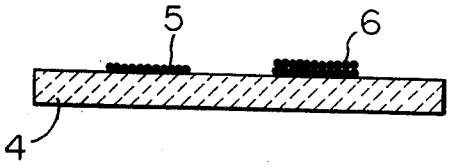
Figure 1C:
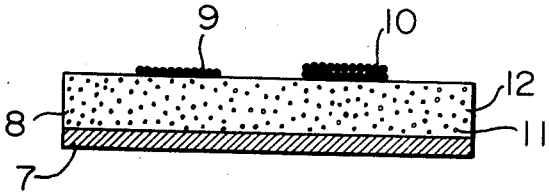
Figure 1D:
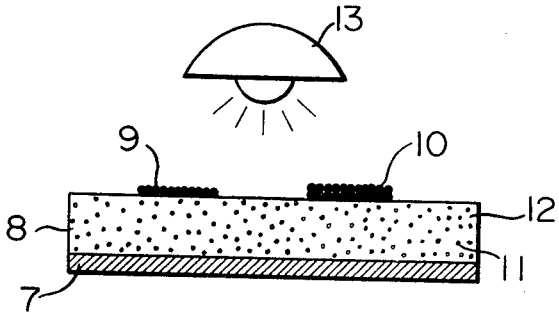
Figure 1E:
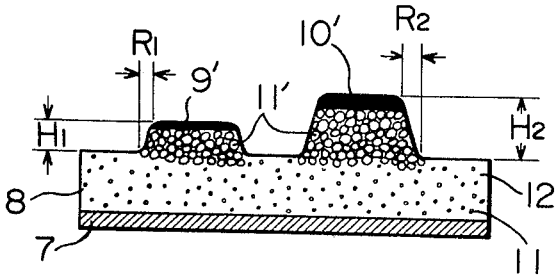

This invention relates to a method for producing a relief formed three-dimensionally on the surface of a sheet in a pattern such as letters, characters, symbols, charts, drawings, and pictures.

Heretofore, reliefs of this kind have been produced by a physical method such as pressing or embossing with a special mold, or by a chemical method such as photographic etching. These methods, however, require complex process steps and long periods of time.

It is an object of this invention to provide a method which removes these defects of the prior art, and which can afford a relief by a simple process within a short period of time.

The present inventor has now found that the above object of this invention can be achieved by using a combination of a material having the property of increasing in volume when heated (e.g., swelling or foaming) and a material having a stronger ability to absorb light than the aforesaid material.

Thus, according to this invention, there is provided a method for producing a relief, which comprises forming a layer of a pattern on the surface of a sheet made of a material having the property of increasing in volume when heated, said pattern being made of a material having a stronger ability to absorb light than the aforesaid material, and then irradiating strong light uniformly on the entire surface of the sheet to selectively heat that portion of the sheet which is adjacent the undersurface of the pattern layer, whereby the pattern layer is raised from the sheet surface corresponding to the increases of the volume of the sheet portion.

Fine spherical thermoplastic microcapsules with a particle size of 10 to 30 microns containing a low-boiling volatile substance such as butane encapsulated in a shell of a polymeric material such as a vinylidene chloride/acrylonitrile copolymer (for example, "MICROPEARL F", a product of Matsumoto Yushi-Seiyaku Co., Ltd) are available as the material having the property of increasing in volume when heated. The sheet used in this invention can be prepared by a known method from a mixture of such microcapsules (preferably in an amount of 10 to 30% by weight) and a binder such as a vinyl acetate polymer (preferably in an amount of 90 to 70% by weight). Sheets prepared from known mixtures of heat-softenable plastics and thermosensitive organic blowing agents such as azobisisobutyronitrile can also be used in this invention.

The material having the stronger ability to absorb light which is used to form the pattern layer on the sheet is, for example, a mixture of a binder and a pigment, a so-called toner, preferably a black toner.

A pattern layer is formed on the sheet surface using such a toner by, for example, hand-drawing the desired pattern on the sheet surface using a toner of the desired color; printing the desired pattern on the sheet surface using a toner of the desired color in accordance with an ordinary printing technique; or duplicating a master drawing having printed thereon the desired pattern on the above sheet surface using a powdery toner containing carbon black in accordance with an ordinary photographic technique.

After the desired pattern is applied by using the toner onto the surface of the sheet, light from a strong light source such as a high-luminance lamp is irradiated on the sheet surface in accordance with this invention. The pattern layer absorbs light more strongly than the sheet, and as a result, only that portion of the sheet which adjoins the undersurface of the pattern layer is selectively heated. The microcapsules in that portion swell (or the foamable plastics in that portion foam), and the pattern layer is raised to a higher position than the sheet surface where the swelling of the microcapsules (or the foaming of the plastics) does not occur. This leads to a relief having the projections conforming to the contour of the pattern on the surface of the sheet.

In the present invention, it is necessary that the raising of the heated sheet portion as a result of the increase of volume (swelling or foaming) should take place on that side of the sheet on which the pattern layer exists. In other words, raising of the back surface of the sheet should be avoided as much as possible. To ensure this, when the sheet is of a specially sensitive type, or when it has a small thickness, it is preferred to apply to the back surface of the sheet a base sheet made of a heat insulating material or a highly rigid material, for example a foamed polystyrene sheet or a thick paper.

Figure 2:
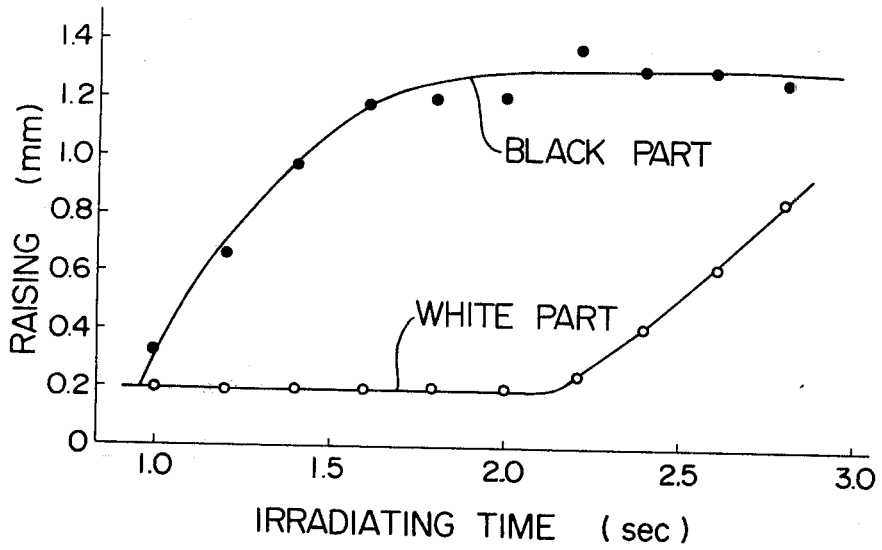
Figure 3:
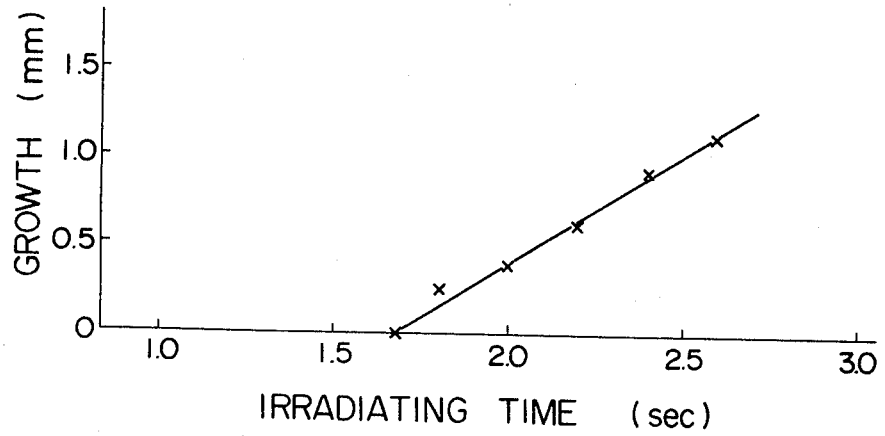
Figure 4:
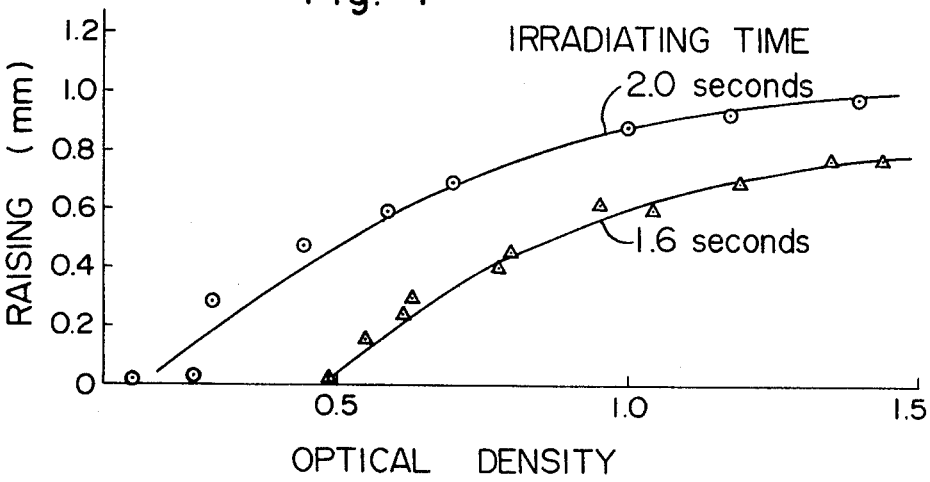
Figure 5:
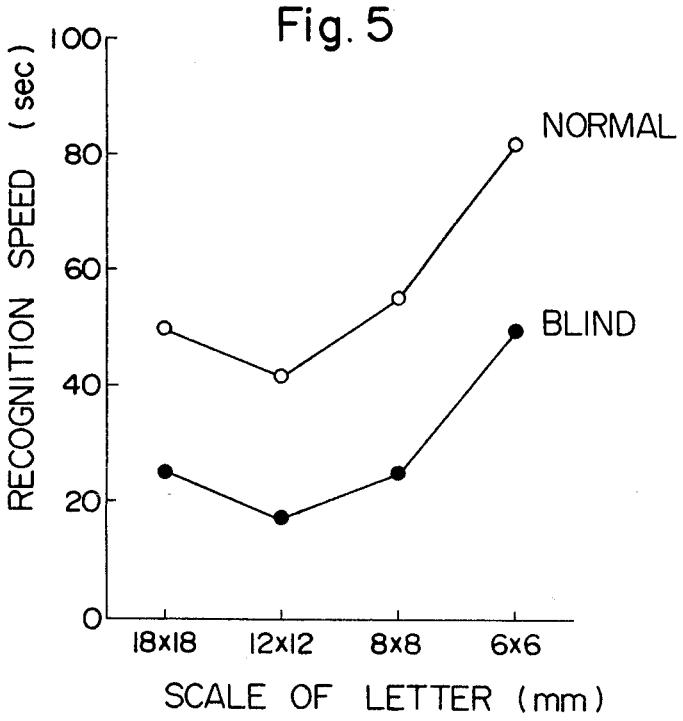

The invention is described specifically with reference to the accompanying drawings in which:

FIGS. 1-*a*, 1-*b*, 1-*c*, 1-*d*, and 1-*e* are side elevations for illustrating the process of a preferred embodiment of the invention;

FIGS. 2, 3 and 4 are graphs illustrating the operating conditions employed in the method of this invention; and FIG. 5 is a graph illustrating the utility of a product obtained by the method of this invention.

In a preferred embodiment of this invention, the same apparatus as a conventional electrophotographic apparatus is used except that a strong light source (for example, a 500 watt rod-like halogen lamp) is mounted and the "sheet made of a material having the property of increasing in volume when heated" is stored instead of recording paper.

FIG. 1-*a* shows a master drawing composed of paper 3 and the desired patterns 1 and 2 printed on the surface of the paper. This master is illustrated to show that the pattern 2 has about twice as high an optical density as the pattern 1. When this master is applied to the aforesaid apparatus, patterns 5 and 6 of a toner are developed on the surface of an electrophotographic layer 4 included in the apparatus as in an ordinary electrophotographic process (at this stage, the toner is not fixed), as shown in FIG. 1-*b*. The pattern 5 corresponds to the pattern 1 of the master, and the pattern 6, to the pattern 2 of the master. Accordingly, the pattern 6 is composed of about twice as much toner as the pattern 5. Next, the patterns 5 and 6 are transferred to a sheet 8 as patterns 9 and 10, as shown in FIGS. 1-*c*. The sheet 8 is made, for example, of microcapsules 11 and a binder 12, and should have weaker light absorbability than the toner which constitutes the patterns 9 and 10. A base sheet 7 such as a foamed polystyrene sheet is bonded to the undersurface of the sheet 8. The sheet 8 having the transferred patterns 9 and 10 is then subjected to irradiation of light from a strong light source 13, as shown in FIG. 1-*d*. Since the toner absorbs light from this irradiation, the patterns 9 and 10 generate heat which is transmitted to that portion of the sheet which is immediately below the patterns 9 and 10. Because the pattern 10 contains a larger amount of toner than the pattern 9, the sheet portion immediately below the pattern 10 is heated more strongly than the sheet portion immediately below the pattern 9. However, that portion of the sheet which does not bear the pattern scarcely develops heat because it has weaker light absorbability. When light irradiation is continued to some extent, the binder 12 contained in the sheet portions immediately below the patterns 9 and 10 is softened to permit expansion of the microcapsules 11. Expansion of the microcapsules raises the patterns 9 and 10 to higher levels from the surface of the sheet portion which does not develop heat. When these patterns have been raised to the desired levels $H_1$ and $H_2$, the light irradiation is stopped. Thus, the toner is heardened at the raised levels, and the patterns are fixed. FIG. 1-*e* shows this state. In this FIGURE, the reference numerals 9' and 10' represent fixed patterns having the same contours as the patterns 1 and 2 on the master drawing. The reference numeral 11' represents expanded microcapsules. Since the pattern 10 contains about twice as much toner as the pattern 9, the sheet portion immediately below the pattern 10 develops about twice as much heat as the sheet portion immediately below the pattern 9, and about twice as many microcapsules are expanded to raise the pattern to about twice as great a height.

In another preferred embodiment of this invention, there is used a sheet composed of microcapsules, a binder and up to 50% by weight, based on the total weight of the two, of a powder of a photoconductive material, for electrophotography (e.g., a powder of zinc oxide). Use of such a sheet makes it possible to develop a pattern directly on the sheet without using the electrophotographic layer 4 (i.e., without a transferring step.) Hence, the desired relief can be produced by a simplified process.

In the method of this invention, an unintended growth of a pattern, i.e. its expansion in the transverse direction ($R_1$ and $R_2$), tends to occur incident to the intended raising ($H_1$ and $H_2$) of the pattern, as shown exaggeratedly in FIG. 1-*e*. FIGS. 2 and 3 show experimental data respectivey showing the relation between the irradiation time and the extent of raising and the relation between the irradiation time and the extent of growth.

In the experiments of FIGS. 2 and 3, a circular pattern having a diameter of 5 mm and an optical density of 1.5 was formed on a 0.2 mm-thick white sheet surface composed of microcapsules (MICRO-PEARL F) and a vinyl acetate polymer using a carbon black-containing toner, and was subjected to irradiation of a 500 watt halogen lamp disposed at a distance of 5 cm above the sheet. FIG. 2 shows that the raising of the pattern (black part) substantially reaches a limit after irradiation for 2 seconds, and after irradiating for 2.2 seconds, raising of that part (white part) of the sheet which does not bear the pattern begins. FIG. 3, on the other hand, shows that growth of the pattern ($R_1$ or $R_2$ in FIG. 1-*e*) begins after irradiation for 1.7 seconds. It is seen therefore from FIGS. 2 and 3 that under the aforesaid conditions, projections free from growth can be formed when the irradiation is performed for a period of time between 1 second and 1.7 seconds.

The height of raising also has to do with the optical density of the pattern. FIG. 4 shows the results of experiments which were performed under the aforesaid conditions except that the optical density of the circular pattern was changed. FIG. 4 thus shows that when the irradiation time is fixed, the raising is higher as the optical density of the pattern is higher.

It is seen from the data shown in FIGS. 2 to 4 that according to this invention, the desired relief can be freely produced by properly adjusting the optical density of the pattern, the intensity of irradiation, the irradiation time, etc.

In the relief obtained by the method of this invention, the projected pattern is formed by the partial raising of the sheet, and the raised pattern is integral with that portion of the sheet which is not raised. Hence, the relief has superior mechanical strength, and does not develop cracks nor drop off.

The relief produced by the method of this invention can be used beneficially as braille articles for the blind (e.g., photographs, drawings, documents, etc. to be recognized by the tactile sense). FIG. 5 shows a graph showing experimental data which demonstrate this.

In the experiment shown in FIG. 5, a recognition test was performed on the blind and normal persons with covered eyes using four types of the relief of this invention compound of a sheet and 10 Roman alphabets of the same scale (6×6 mm, 8×8 mm, 12×12 mm, or 18×18 mm) raised to a height of 0.5 mm. FIG. 5 shows the average of the recognition speeds for 10 alphabets of each scale. It is seen that the recognition speed of the blind is much faster than that of the normal persons. This fact shows that the reliefs of this invention are very easy for the blind to recognize. The especially fast recognition speed with alphabets of a size of 12×12 mm is attributed to the fact that the size of the finger tip corresponds substantially to this size.

In addition, the reliefs made by the method of this invention can also be applied to fields where the above-described structure and properties can be utilized advantageously, for example to master sheets for relief printing, and to three-dimensional maps.

What is claimed is:

1. A method for producing a relief having a height of at least about 0.5–0.6 mm for use as a braille article for the blind which comprises applying a pattern layer to the surface of a sheet material made of a mixture of a binder and fine spherical thermoplastic capsules containing a volatile substance in a shell, said pattern layer being a material having a stronger ability to absorb light than the said sheet material, and uniformly irradiating with strong light the entire surface of the sheet to selectively heat that portion of the surface of the sheet which is adjacent the undersurfaces of the pattern layer, whereby the pattern layer is raised from the surface of the sheet in an amount corresponding to the increase of the volume of the sheet portion.

2. A method according to claim 1 wherein the sheet material contains on the surface opposite the pattern layer a base sheet made of a heat insulating or highly rigid material.

3. A method for producing a relief having a height of at least about 0.5–0.6 mm for use as a braille article for the blind which comprises applying a pattern layer by an electrophotographic technique to the surface of a sheet material made of a mixture of a binder, fine spherical thermoplastic capsules containing a volatile substance in a shell and a powder of a photoconductive material for electrophotography, said pattern layer being a material having a stronger ability to absorb light than the said sheet material, and uniformly irradiating with strong light the entire surface of the sheet to selectively heat that portion of the surface of the pattern layer, whereby the pattern layer is raised from the surface of the sheet in an amount corresponding to the increase of the volume of the sheet portion.

4. A method according to claim 3 wherein the sheet material contains on the surface opposite the pattern layer a base sheet made of a heat insulating or highly rigid material.

* * * * *